US007788755B2

(12) United States Patent
Lee et al.

(10) Patent No.: US 7,788,755 B2
(45) Date of Patent: Sep. 7, 2010

(54) APPARATUS FOR SENSING TYPE OF UNBALANCE OF WASHING MACHINE AND METHOD THEREOF

(75) Inventors: Dong-Soo Lee, Seoul (KR); Dong-Won Kim, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 994 days.

(21) Appl. No.: 11/465,534

(22) Filed: Aug. 18, 2006

(65) Prior Publication Data

US 2007/0039104 A1 Feb. 22, 2007

(30) Foreign Application Priority Data

Aug. 19, 2005 (KR) ..... 10-2005-0076414

(51) Int. Cl.
*D06F 35/00* (2006.01)

(52) U.S. Cl. ..... 8/158; 68/12.02; 68/12.06

(58) Field of Classification Search ..... None
See application file for complete search history.

(56) References Cited

U.S. PATENT DOCUMENTS 6,507,799 B2 * 1/2003 Steffen ..... 702/96
6,654,975 B2 * 12/2003 Broker ..... 8/159
2005/0028296 A1 2/2005 Lee et al.

OTHER PUBLICATIONS

U.S. Appl. No. 11/465,557 to Lee et al. , which was filed Aug. 18, 2006.

* cited by examiner

*Primary Examiner*—Michael Barr
*Assistant Examiner*—Jason Y Ko
(74) *Attorney, Agent, or Firm*—Ked & Associates LLP

(57) ABSTRACT

A method for sensing a type of an unbalance of a washing machine is provided. The method may include detecting a vibration amount of a tub using a multi-axis acceleration sensor; detecting a vibration amount of an rpm of a motor; and judging a type of an unbalance based on the vibration amount and the rpm vibration amount. The method may also include detecting a vibration amount of a tub at a plurality of positions of the tub using a plurality of multi-axis acceleration sensors; detecting a time difference of vibration occurrence at the plurality of positions, and thereby calculating a vibration phase difference; and judging a type of an unbalance based on the vibration amount detected at the plurality of positions and the vibration phase difference.

6 Claims, 6 Drawing Sheets

APPARATUS FOR SENSING TYPE OF UNBALANCE OF WASHING MACHINE AND METHOD THEREOF

RELATED APPLICATION

The present disclosure relates to subject matter contained in priority Korean Application No. 10-2005-0076414, filed on Aug. 19, 2005, which is herein expressly incorporated by reference in its entirety.

BACKGROUND OF THE INVENTION

1. Field of the Invention

The present invention relates to an apparatus for sensing a type of an unbalance of a washing machine and a method thereof, and more particularly, to an apparatus for sensing a type of an unbalance of a washing machine with using a multi-axis acceleration sensor, and a method thereof.

2. Description of the Background Art

Generally, a washing machine serves to wash laundry by applying a mechanical force such as friction, vibration, etc. to the laundry immersed in washing water.

The washing machine performs a washing operation for washing laundry mixed with washing water by applying a mechanical force, a rinsing operation for separating the washing water from the laundry, and a dehydrating operation for separating the rinsing water from the laundry.

However, when the laundry is not uniformly distributed (unbalance occurrence) in the washing machine, vibration and noise are caused in the dehydrating operation. Therefore, a function for sensing a type of an unbalance of the washing machine and uniformly distributing the laundry is required.

FIG. 1 is a flowchart showing a method for sensing a type of an unbalance of a washing machine and dehydrating laundry in accordance with the related art. As shown, the related art method for sensing a type of an unbalance of a washing machine and dehydrating laundry comprises: driving a washing motor with a low speed (S11); detecting an unbalance amount of laundry by detecting a variation amount of an rpm of the motor (S12); comparing the detected unbalance amount with a preset reference value (S13); and uniformly distributing the laundry when the detected unbalance amount is greater than the preset reference value (S14*a*), and increasing the rpm of the washing machine when the detected unbalance amount is less than the preset reference value (S14*b*).

In the step of detecting an unbalance amount (S12), the rpm is periodically detected with using a speed detecting sensor mounted at a washing machine motor, and an unbalance amount is detected based on a difference between a maximum value and a minimum value of the rpm.

Whether a dehydrating process is to be immediately performed or is to be performed after the laundry uniformly-distributing process is judged by comparing the detected unbalance amount with the preset reference value.

However, in the related art washing machine, since an unbalance amount is detected by detecting only an rpm of a motor, an unbalance having a less correlation with the rpm can not be detected.

For instance, when an unbalance due to a diagonal load is caused, vibration of a tub is severely generated in upper and lower directions. However, the rpm of the motor is not greatly decreased, and thus the unbalance is not detected. When a dehydrating process is performed without considering the unbalance, noise is greatly caused and a mal-function of the washing machine is caused.

SUMMARY OF THE INVENTION

Therefore, an object of the present invention is to provide an apparatus for sensing a type of an unbalance of a washing machine capable of sensing a type of an unbalance of a washing machine by detecting a vibration amount of a tub, and by detecting a variation amount of an rpm of a motor with using a speed detecting sensor, and a method thereof.

To achieve these and other advantages and in accordance with the purpose of the present invention, as embodied and broadly described herein, there is provided a method for sensing a type of an unbalance of a washing machine, comprising: detecting a vibration amount of a tub at plural positions of the tub with using plural multi-axis acceleration sensors; detecting a time difference of vibration occurrence at the plural positions, and thereby calculating a vibration phase difference; and judging a type of an unbalance based on the vibration amount detected at the plural positions and the vibration phase difference.

Another object of the present invention is to provide a method for sensing a type of an unbalance of a washing machine capable of sensing a type of an unbalance of a washing machine by detecting a vibration amount of a tub, and by detecting a vibration phase difference of the detected vibration amount.

To achieve these and other advantages and in accordance with the purpose of the present invention, as embodied and broadly described herein, there is also provided an apparatus for sensing a type of an unbalance of a washing machine, comprising: a vibration amount detecting unit for detecting a vibration amount of a tub at plural positions of the tub with using plural multi-axis acceleration sensors; a vibration phase difference calculating unit for calculating a vibration phase difference by detecting a time difference of vibration occurrence at the plural positions; and an unbalance type judging unit for judging a type of an unbalance based on the vibration amount detected at the plural positions and the vibration phase difference.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
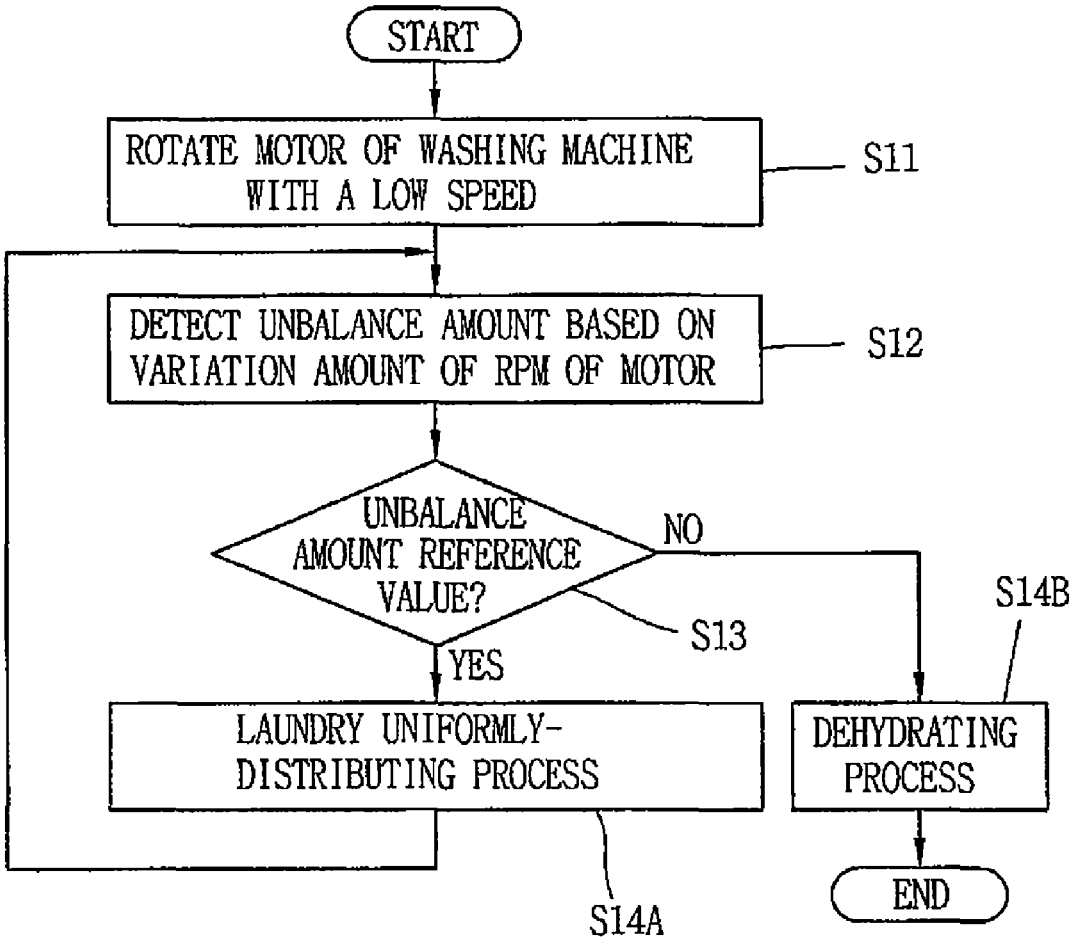
FIG. 1 RELATED ART
FIG. 1 is a flowchart showing a method for sensing an unbalance amount of a washing machine in accordance with the related art.

Reference will now be made in detail to the preferred embodiments of the present invention, examples of which are illustrated in the accompanying drawings.

Hereinafter, with reference to FIGS. 2 to 6, will be explained an apparatus for sensing a type of an unbalance of a washing machine capable of sensing a type of an unbalance of a washing machine by detecting a vibration amount of a tub with using a multi-axis acceleration sensor, and by detecting a variation amount of an rpm of a motor with using a speed detecting sensor, and a method thereof.

When a value obtained by dividing the detected vibration amount by the rpm variation amount is greater than a preset reference value, it is judged that an unbalance due to a diagonal load is caused.

A method for sensing a type of an unbalance of a washing machine according to a first embodiment of the present invention comprises: detecting a vibration amount of a tub with using a multi-axis acceleration sensor; detecting a variation amount of an rpm of a motor; and judging a type of an unbalance by the variation amount of the rpm and the vibration amount.

In the step of judging a type of an unbalance, when a value obtained by dividing the detected vibration amount by the detected rpm variation amount is greater than a preset reference value, it is judged that an unbalance due to a diagonal load is caused.

According to a second embodiment of the present invention, there is provided a method for sensing a type of an unbalance of a washing machine, comprising: detecting a vibration amount of a tub at plural positions of the tub with using plural multi-axis acceleration sensors; detecting a time difference of vibration occurrence at the plural positions, and thereby calculating a vibration phase difference; and judging a type of an unbalance based on the vibration amount detected at the plural positions and the vibration phase difference.

The plural multi-axis acceleration sensors are installed at the tub so as to detect each vibration generated at plural axes on upper, lower, front, and rear surfaces of the tub in the step of detecting a vibration amount at the plural positions of the tub.

In the step of judging a type of an unbalance, when the vibration phase difference is '0' and a vibration amount generated from an entire surface of the tub is in a range of a certain error, it is judged that an unbalance due to a center load is caused.

In the step of judging a type of an unbalance, when the vibration phase difference is not '0' and a vibration amount generated in a Z-axis direction of a front surface of the tub is largest among the detected vibration amount, it is judged that an unbalance due to a front load is caused.

In the step of judging a type of an unbalance, when the vibration phase difference is not '0' and a vibration amount generated in a Z-axis direction of a rear surface of the tub is largest among the detected vibration amount, it is judged that an unbalance due to a rear load is caused.

In the step of judging a type of an unbalance, when the vibration phase difference is not '0' and a vibration amount generated from a front surface and a rear surface of the tub is largest among the detected vibration amount, it is judged that an unbalance due to a diagonal load is caused.

Hereinafter, the preferred embodiments of the present invention will be explained in more detail.

Figure 2:
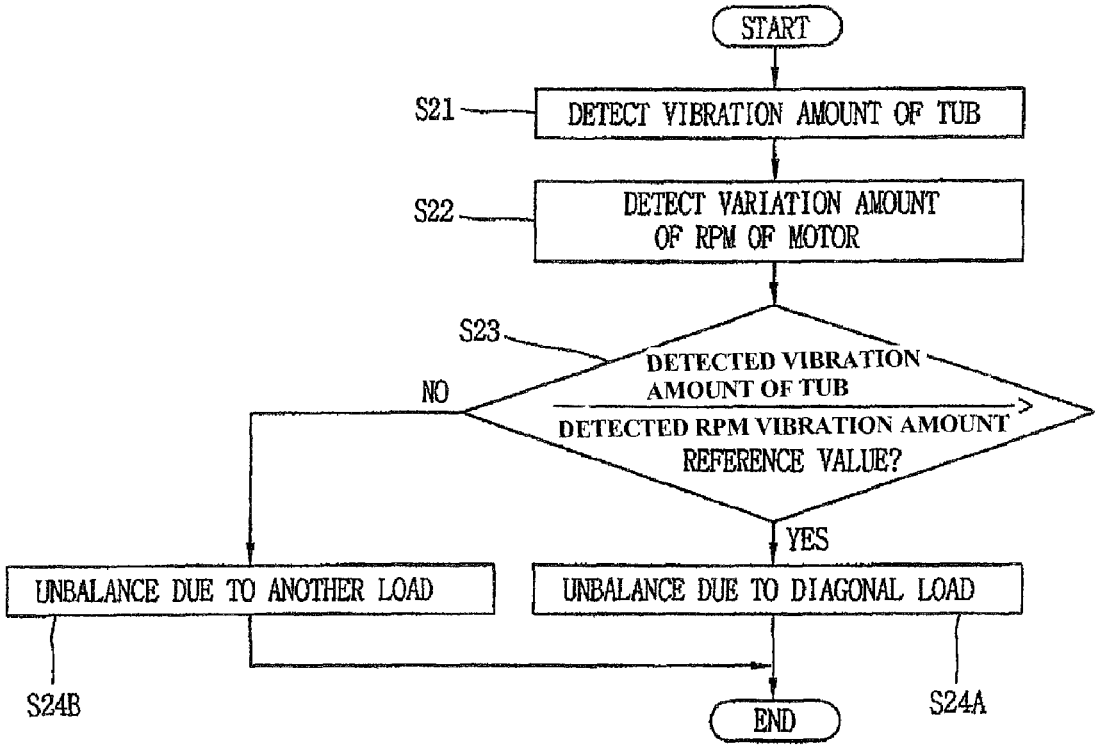
FIG. 2 is a flowchart showing a method for sensing a type of an unbalance of a washing machine according to a first embodiment of the present invention.

FIG. 2 is a flowchart showing a method for sensing a type of an unbalance of a washing machine according to a first embodiment of the present invention. As shown, the method for sensing a type of an unbalance of a washing machine according to a first embodiment of the present invention comprises: detecting a vibration amount of a tub with using a multi-axis acceleration sensor (S21); detecting a variation amount of an rpm of a motor with using a speed detecting sensor (S22); comparing a value obtained by dividing the detected vibration amount of the tub by the detected rpm variation amount with a reference value (S23); when the value is greater than the reference value, judging that an unbalance due to a diagonal load is caused (S24*a*); and when the value is less than the reference value, judging that an unbalance due to another load is caused (S24*b*).

The acceleration sensor serves to momentarily detect a physical force such as an acceleration, a vibration, an impact, etc. thereby to output the physical force as an electrical signal. The acceleration sensor can be variously classified into an electric capacity type, a piezoelectric resistance type, a piezoelectric type, a movable coil type, an eddy current type, etc. according to a detecting principle.

The multi-axis acceleration sensor serves to momentarily detect a vibration amount from plural axes of the tub, and is preferably installed on a surface of the tub.

When an unbalance due to a diagonal load (laundry is concentrated in the tub in a diagonal direction) is caused, a variation amount of the rpm of the motor is relatively small and a vibration amount of the tub is relatively large.

In step S23, a value obtained by dividing the vibration amount of the tub by the variation amount of the rpm of the motor is compared with a reference value. Herein, if the value obtained by dividing the vibration amount of the tub by the variation amount of the rpm of the motor is greater than the reference value, it is judged that an unbalance due to a diagonal load is caused.

Figure 3:
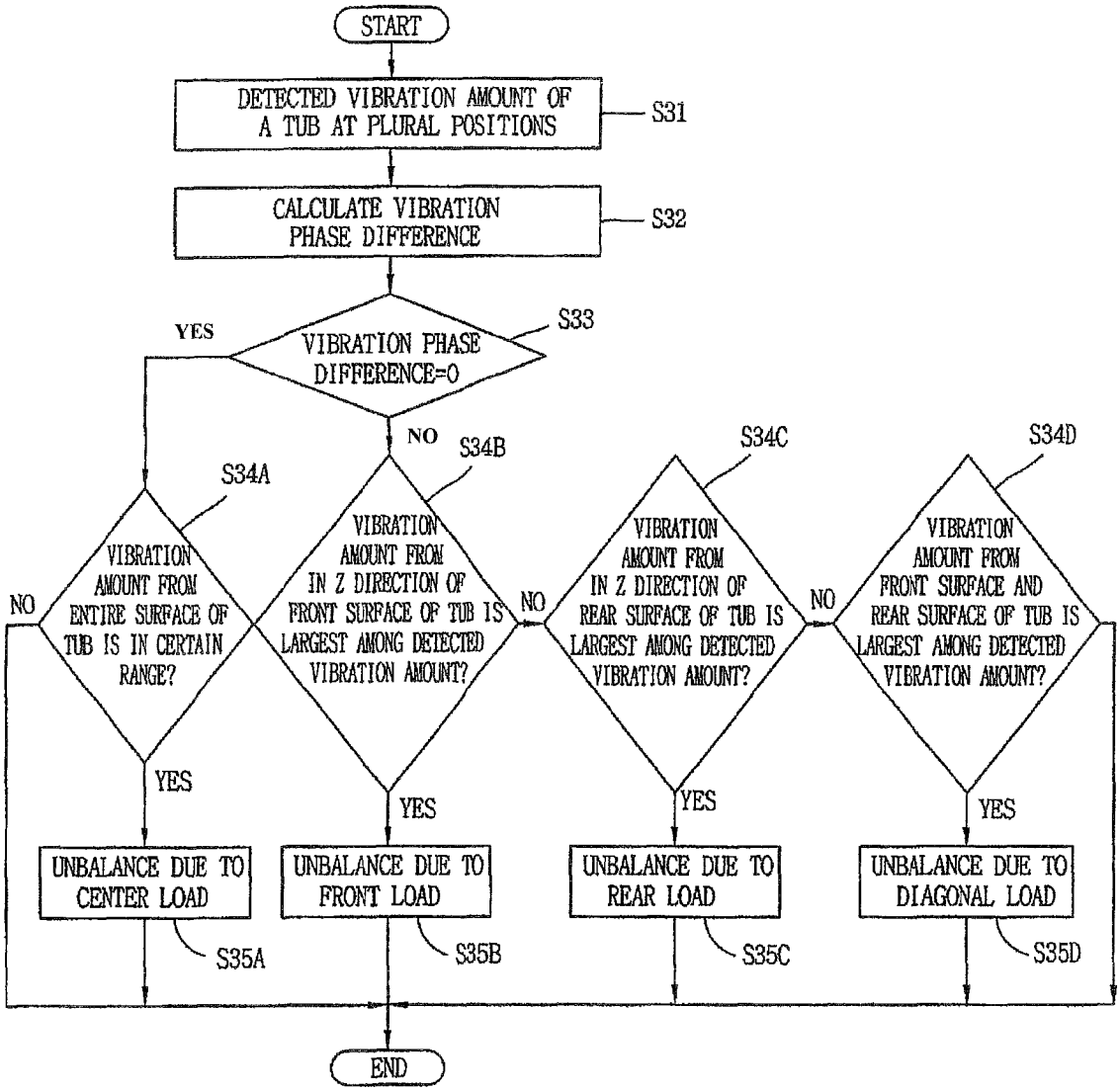
FIG. 3 is a flowchart showing a method for sensing a type of an unbalance of a washing machine according to a second embodiment of the present invention.

FIG. 3 is a flowchart showing a method for sensing a type of an unbalance of a washing machine according to a second embodiment of the present invention. The method for sensing a type of an unbalance of a washing machine according to a second embodiment of the present invention comprises: detecting a vibration amount of a tub at plural positions of the tub with using plural multi-axis acceleration sensors (S31); detecting a time difference of vibration occurrence at the plural positions, and thereby calculating a vibration phase difference (S32); and judging a type of an unbalance based on the vibration amount detected at the plural positions and the vibration phase difference.

More concretely, the plural multi-axis acceleration sensors are installed at plural positions of the tub thus to detect a vibration amount of the tub according to each axis (X, Y, and Z), and a time difference of vibration occurrence (vibration phase difference) is detected. Then, a type of an unbalance of the washing machine is judged according to the detected vibration amount and the vibration phase difference.

The plural multi-axis acceleration sensors are installed at the tub so as to detect each vibration generated at plural axes on upper, lower, front, and rear surfaces of the tub. For instance, the plural multi-axis acceleration sensors can be installed at an upper front surface and a lower rear surface of the tub.

The steps of judging a type of an unbalance (S33 to S35D) comprise: judging whether the vibration phase difference is '0' (S33); when the vibration phase difference is '0' and a vibration amount generated from an entire surface of the tub is in a certain range, judging that an unbalance due to a center load is caused (S34*a*, 35A); when the vibration phase difference is not '0' and a vibration amount generated in a Z-axis direction of a front surface of the tub is largest among the detected vibration amount, judging that an unbalance due to a front load is caused (S34*b*, 35B); when the vibration phase difference is not '0' and a vibration amount generated in a Z-axis direction of a rear surface of the tub is largest among the detected vibration amount, judging that an unbalance due to a rear load is caused (S34*c,* 35C); and when the vibration phase difference is not '0' and a vibration amount generated from a front surface and a rear surface of the tub is largest among the detected vibration amount, judging that an unbalance due to a diagonal load is caused (S34*d,* 35D).

Hereinafter, the preferred embodiments of the present invention will be explained in more detail.

A vibration pattern of the tub according to a type of an unbalance will be explained with reference to FIGS. 4A to 4D.

Figure 4A:
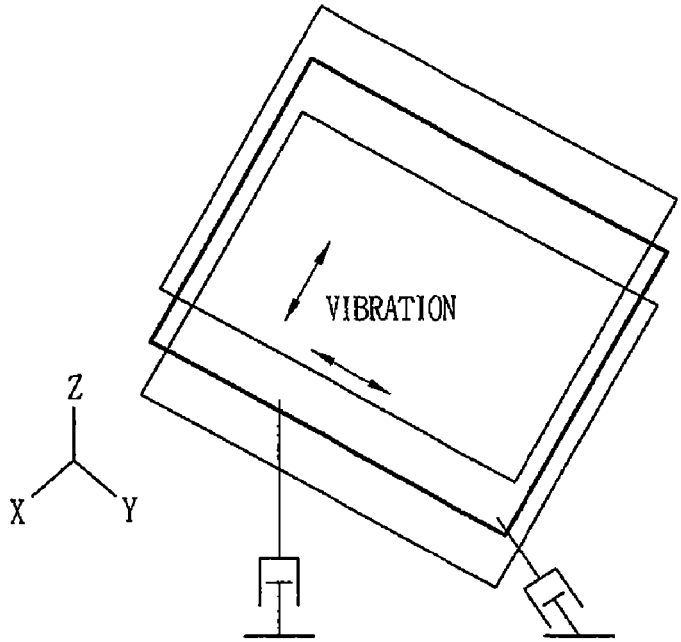
FIGS. 4A to 4D are explanation views showing a method for sensing a type of an unbalance of a washing machine according to the present invention.
Figure 4B:
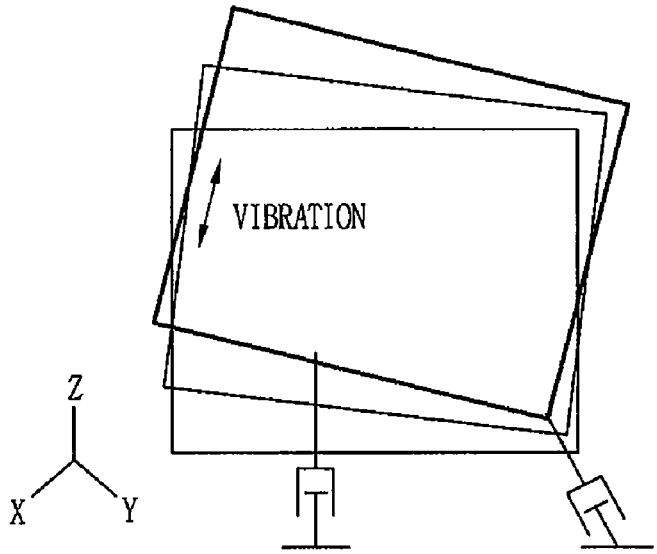
Figure 4C:
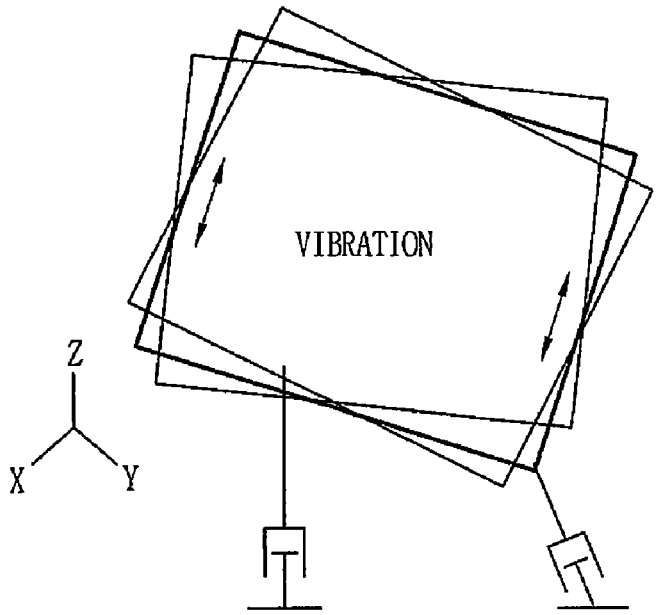
Figure 4D:
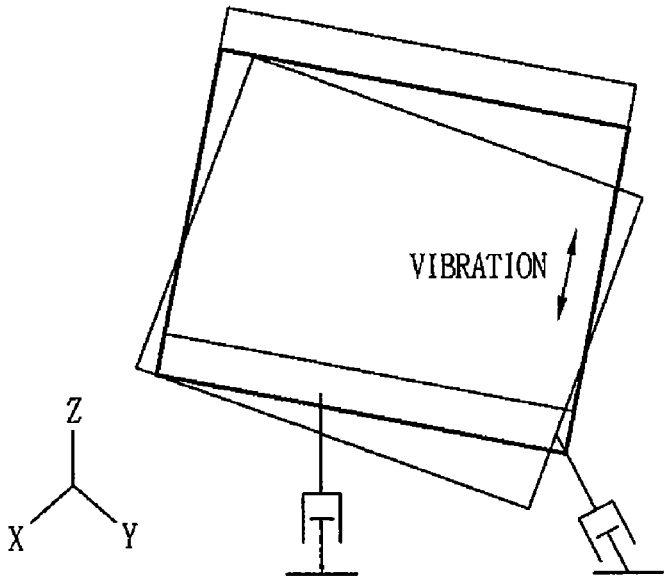
Figure 5:
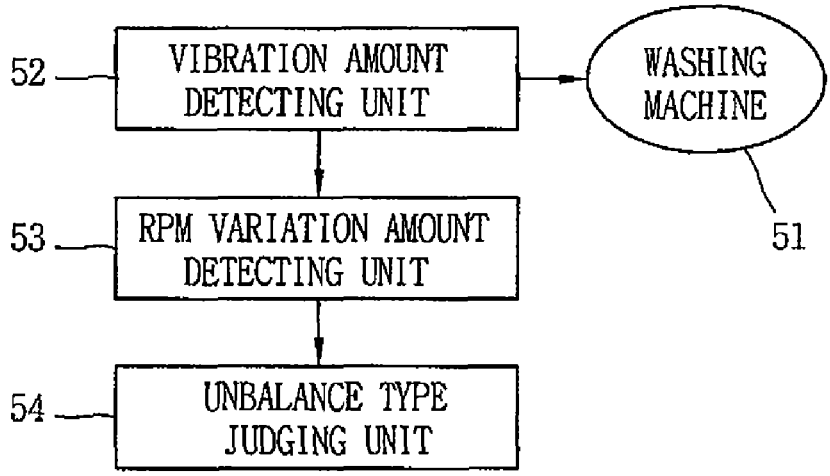
FIG. 5 is a block diagram showing an apparatus for sensing a type of an unbalance of a washing machine according to a first embodiment of the present invention.
Figure 6:
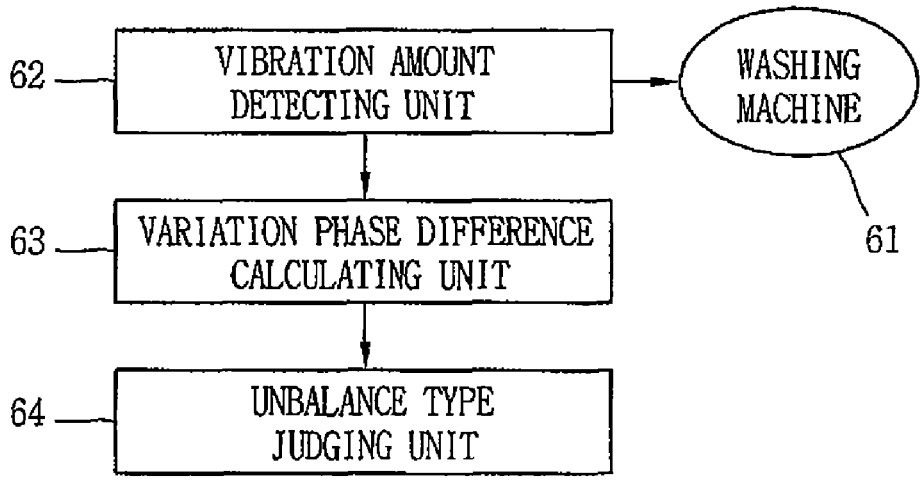
FIG. 6 is a block diagram showing an apparatus for sensing a type of an unbalance of a washing machine according to a second embodiment of the present invention.

FIGS. 4A to 4D are views showing a method for sensing a type of an unbalance of a washing machine according to the present invention, in which FIG. 4A shows an unbalance due to a center load, FIG. 4B shows an unbalance due to a front load, FIG. 4C shows an unbalance due to a rear load, and FIG. 4D shows an unbalance due to a diagonal load.

Referring to FIG. 4A, the tub is uniformly displaced without a vibration phase difference in X, Y, and Z directions when the motor is rotated, which means that an unbalance due to a center load (laundry is concentrated into the center of the tub) is caused.

Referring to FIG. 4B, a front surface of the tub is greatly displaced with a vibration phase difference in the Z direction when the motor is rotated, which means that an unbalance due to a front load (laundry is concentrated into the front surface of the tub) is caused.

Referring to FIG. 4C, a rear surface of the tub is greatly displaced with a vibration phase difference in the Z direction when the motor is rotated, which means that an unbalance due to a rear load (laundry is concentrated into the rear surface of the tub) is caused.

Referring to FIG. 4D, the front surface and the rear surface of the tub is greatly displaced with a vibration phase difference in the Z direction when the motor is rotated, which means that an unbalance due to a diagonal load (laundry is concentrated into the front surface and the rear surface of the tub, or into a diagonal direction) is caused.

In the present invention, different laundry uniformly-distributing processes are performed according to each type of unbalance, thereby fast and properly controlling the unbalance of the washing machine.

An apparatus for sensing a type of an unbalance according to a first embodiment of the present invention comprises: a vibration amount detecting unit 52 for detecting a vibration amount of a tub with using plural multi-axis acceleration sensors; an rpm variation amount detecting unit 53 for detecting a variation amount of an rpm of a motor; and an unbalance type judging unit 54 for judging a type of an unbalance based on the vibration amount and the rpm variation amount.

When a value obtained by dividing the vibration amount of the tub by the rpm variation amount of the motor is larger than a reference value, it is judged that an unbalance due to a diagonal load is caused.

An apparatus for sensing a type of an unbalance according to a second embodiment of the present invention comprises: a vibration amount detecting unit 61 for detecting a vibration amount of a tub at plural positions of the tub with using plural multi-axis acceleration sensors; a vibration phase difference calculating unit 62 for detecting a time difference of vibration occurrence at the plural positions of the tub, and thereby calculating a vibration phase difference; and an unbalance type judging unit 63 for judging a type of an unbalance based on the vibration amount detected at the plural positions and the vibration phase difference.

The vibration amount detecting unit 61 detects each vibration generated from plural axes positioned at upper, lower, front, and rear surfaces of the tub with using the plural multi-axis acceleration sensors installed at the tub.

When the vibration phase difference is '0' and a vibration amount generated from an entire surface of the tub is in a range of a certain error, it is judged that an unbalance due to a center load is caused.

When the vibration phase difference is not '0' and a vibration amount generated in a Z-axis direction of a front surface of the tub is largest among the detected vibration amount, it is judged that an unbalance due to a front load is caused.

When the vibration phase difference is not '0' and a vibration amount generated in a Z-axis direction of a rear surface of the tub is largest among the detected vibration amount, it is judged that an unbalance due to a rear load is caused.

When the vibration phase difference is not '0' and a vibration amount generated from a front surface and a rear surface of the tub is largest among the detected vibration amount, it is judged that an unbalance due to a diagonal load is caused.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A method for sensing a type of an unbalance of a washing machine, the method comprising:

detecting a vibration amount of a tub of the washing machine at a plurality of positions of the tub using a plurality of multi-axis acceleration sensors;

detecting a time difference of vibration occurrence at the plurality of positions of the tub, and thereby calculating a vibration phase difference; and judging a type of an unbalance based on the vibration amounts detected at the plurality of positions of the tub and the vibration phase difference.

2. The method of claim 1, wherein in the detecting a vibration amount of a tub, the plurality of multi-axis acceleration sensors are installed on the tub so as to detect each vibration generated at a plurality of axes on upper, lower, front, and rear surfaces of the tub.

3. The method of claim 1, wherein when the vibration phase difference is '0' and a vibration amount generated from an entire surface of the tub is within a predetermined range of error, it is judged that the unbalance of the washing machine is caused due to a center load.

4. The method of claim 1, wherein when the vibration phase difference is not '0' and a vibration amount generated in a Z-axis direction of a front surface of the tub is largest among the detected vibration amounts, it is judged that the unbalance of the washing machine is caused due to a front load.

5. The method of claim 1, wherein when the vibration phase difference is not '0' and a vibration amount generated in a Z-axis direction of a rear surface of the tub is largest among the detected vibration amounts, it is judged that the unbalance of the washing machine is caused due to a rear load.

6. The method of claim 1, wherein when the vibration phase difference is not '0' and a vibration amount generated from a front surface and a rear surface of the tub is largest among the detected vibration amounts, it is judged that the unbalance of the washing machine is caused due to a diagonal load.

* * * * *